United States Patent [19]

Matthews

[11] Patent Number: 4,841,700

[45] Date of Patent: Jun. 27, 1989

[54] NARROW FLUSH GLAZED THERMAL FRAMING

[75] Inventor: Thomas E. Matthews, Lilburn, Ga.

[73] Assignee: Kawneer Company, Inc., Norcross, Ga.

[21] Appl. No.: 229,127

[22] Filed: Aug. 5, 1988

[51] Int. Cl.[4] ..... E04B 2/28

[52] U.S. Cl. ..... 52/235; 52/403; 52/731; 49/DIG. 1; 49/DIG. 2

[58] Field of Search ..... 52/403, 731, DIG. TB, 52/235; 49/DIG. 1, DIG. 2

[56] References Cited

U.S. PATENT DOCUMENTS

| | | | |
|---|---|---|---|
| 3,023,859 | 3/1962 | Muessel . | |
| 3,579,939 | 5/1971 | Eichman . | |
| 3,881,287 | 5/1975 | Biebuyck . | |
| 3,881,294 | 5/1975 | Biebuyck . | |
| 3,916,595 | 11/1975 | Biebuyck . | |
| 3,978,629 | 9/1976 | Echols . | |
| 4,187,657 | 2/1980 | Sukolics | 52/403 X |
| 4,314,424 | 12/1979 | Gordon | 49/DIG. 1 X |
| 4,377,926 | 3/1983 | Coulston et al. . | |

FOREIGN PATENT DOCUMENTS

| | | | |
|---|---|---|---|
| 2081786 | 8/1980 | United Kingdom | 52/DIG. TB |
| 2060750 | 5/1981 | United Kingdom | 52/403 |

*Primary Examiner*—David A. Scherbel
*Assistant Examiner*—Jerrold D. Johnson
*Attorney, Agent, or Firm*—Frank A. Peacock

[57] ABSTRACT

The invention provides a thermal break configuration in a flush glazed, two-piece mullion which permits a reduced face dimension without reducing the depth of the glazing channels of the mullion. The invention is directed to a thermal break segmented filler assembly for the shallow glazing pocket in narrow flush glazed two-piece framing for curtainwalls, storefronts, and the like. The two-piece mullions have a major portion and a filler portion, both of which are extruded profiles. The filler assembly incorporates a thin thermal break which makes it possible to reduce the mullion face dimension and still provide a glazing pocket depth equal to that of conventional flush glazed thermal framing. The thin thermal break of the filler assembly includes a plastic channel extrusion having rigid upturned legs with relatively soft barbs which engage channels in aluminum extrusion filler halves. The thermal break filler element is snap fit onto and between the filler halves to form a three-piece filler assembly.

6 Claims, 3 Drawing Sheets

NARROW FLUSH GLAZED THERMAL FRAMING

BACKGROUND OF THE INVENTION

The present invention generally relates to flush glazed framing systems and particularly relates to narrow flush glazed framing having a thermal break.

Flush glazed framing refers to curtainwall or storefront framing having alternating shallow and deep glazing pockets so that the framing can be permanently installed prior to glazing and so that glazing can be installed without need of lateral fixtures on the framing which would increase the face dimension of the framing members. It is desirable for architectural aluminum framing to provide a minimum face dimension, commonly termed "sight line".

Conventionally, in aluminum flush glazed framing to provide a thermal break, a poured and debridged area is included in the base of the glazing pockets. Adjacent thermal breaks in the bases of the shallow and deep glazing pockets are staggered in an attempt to minimize the face dimension of the mullion. Typical face dimensions achieved with that configuration are 2.25 and 2.50 inches.

U.S. Pat. No. 3,023,859, Mar. 6, 1962, to Muessel discloses basic narrow flush glazed framing in which vertical framing members have alternating deep and shallow glazing channels so that vertical mullions may be installed before the glass panels are mounted in the framing.

U.S. Pats. Nos. 3,881,287, May 6, 1975; 3,881,294, May 6, 1975; and 3,916,595, Nov. 4, 1975, to Biebuyck disclose narrow flush glazed framing in which shallow glazing channels are opposed, but contiguous with one of the shallow channels is a deep glazing area so that a glass panel may be first inserted into the deep glazing area of one mullion and then shifted from the deep glazing area to the normal shallow glazing area contiguous to provide retention of the panel in confronting shallow glazing pockets.

U.S. Pat. No. 4,377,926, Mar. 29, 1983, to Coulston et al is directed to narrow flush glazed framing having a thermal break. Cast thermal break material structurally secures the face component of a framing mullion to the interior portion of the mullion.

SUMMARY OF THE INVENTION

It is a primary object of the invention to provide an improved thermal break configuration in a flush glazed mullion which permits a reduced face dimension without correspondingly reducing the depth of the glazing channels of the mullion.

The invention is directed to a thermal break segmented filler assembly for the shallow glazing pocket in narrow flush glazed two-piece framing for curtainwalls, storefronts, and the like. The two-piece mullions have a major portion and a filler portion, both of which are extruded profiles. The filler assembly incorporates a thin thermal break which makes it possible to reduce the mullion face dimension and still provide a glazing pocket depth equal to that of conventional flush glazed thermal framing. The thin thermal break of the filler assembly includes a plastic channel extrusion having rigid upturned legs with relatively soft barbs which engage channels in aluminum extrusion filler halves. The thermal break filler element is snap fit onto and between the filler halves to form a three-piece filler assembly.

Accordingly, the invention provides a thermal mullion for narrow flush glazed framing, including an extruded profile having on one side a deep glazing channel and on the opposed side a slot for forming a shallow glazing channel; a thermal break in the deep glazing channel; and a thermal break filler assembly secured in the slot and configured to form a shallow glazing channel and formed at least in part of a relatively low thermal conductivity material.

The mullion preferably includes a pour-debridge thermal break in the base of the deep glazing channel.

The thermal break filler assembly includes a thin thermal break such that the mullion face dimension is reduced relative to elimination of a pour-debridge thermal break without a corresponding reduction in the glazing pocket depth. The thermal break filler assembly preferably includes a plastic channel extrusion having rigid upturned legs with relatively soft coextruded barbs which engage channels in aluminum extrusion filler halves, such that the thermal break filler element is snap fit onto and between the filler halves to form a three-piece filler assembly.

The invention further comprehends a narrow flush glazed thermal framing system in which the thermal mullions comprise the vertical framing members of the framing system.

The framing system preferably includes screw-spline securement of the horizontal mullions to the vertical mullions, the screw-spline securement on the filler side of the vertical mullions passing through the filler assembly in the respective vertical mullion.

DETAILED DESCRIPTION

Figure 1:
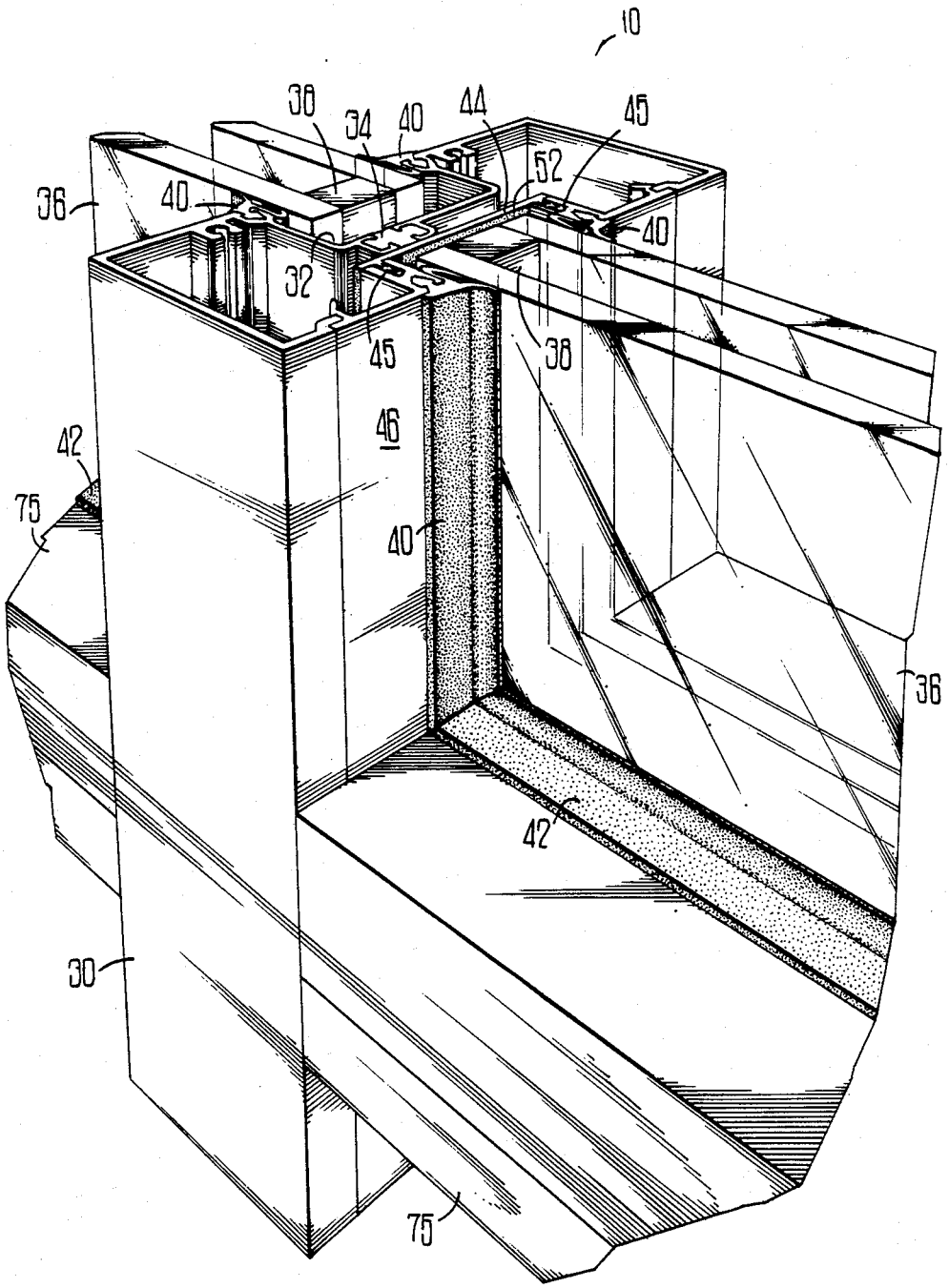
FIG. 1 is a pictorial view of thermally broken narrow flush glazed framing, according to a preferred embodiment of the invention, in which vertical framing members have alternating deep and shallow glazing pockets and a thermal break filler assembly in the shallow glazing pockets.

Referring now in detail to the drawings, in which like numerals represent like parts throughout the several views, FIG. 1 shows a typical framing configuration 10 at an intersection of a vertical mullion 30 and a horizontal mullion 75. The framing supports a dual panel glass panel 36 which is secured in the framing by vertical glazing gaskets 40 and horizontal glazing gaskets 42 around the perimeter of the glass panel.

The framing is characterized as flush glazed framing in that there is no buildup of the facial dimension of the vertical framing members with additional lateral fixtures to secure the glass panels in the mullion. Flush glazed framing requires alternating deep glazing channels 32 and shallow glazing channels 52 so that a glass panel can be installed after the framing has been completely installed. The flush glazed framing is also thermally broken in that a pour-debridge thermal break 34 is provided in the deep glazing channel 32 and a thermal break material is used to form the base 44 of the shallow glazing channel 52. The framing may be further characterized as narrow flush glazed thermal framing in that the sight-line of the vertical mullions is reduced relative to similar framing having a pour-debridge thermal break in the base of the shallow glazing channel, as well as in the deep glazing channel.

Figure 2:
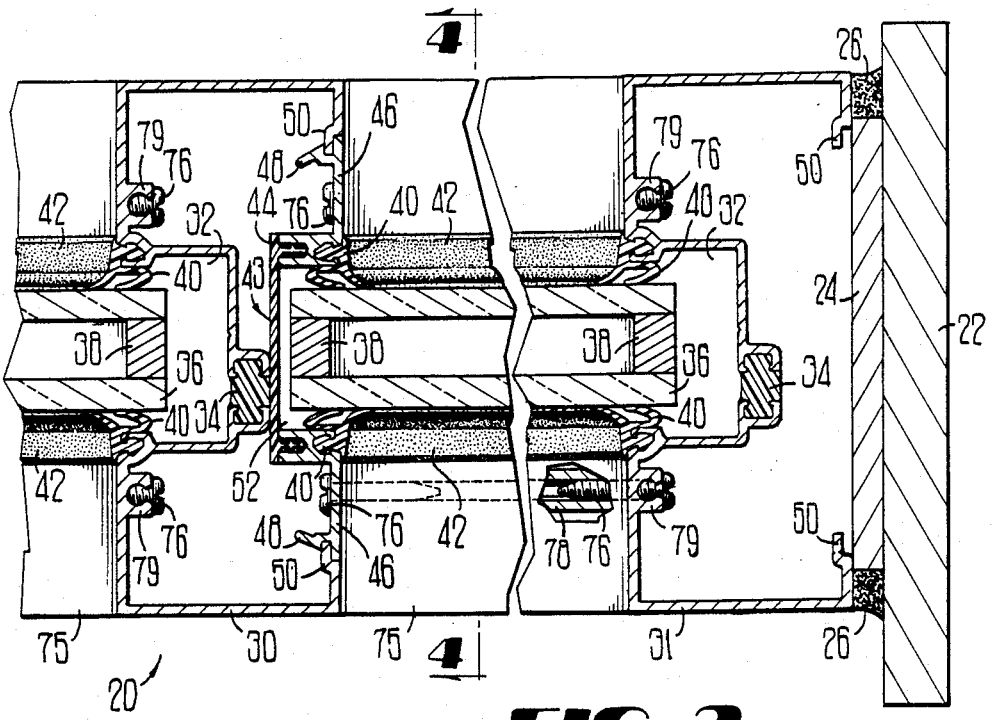
FIG. 2 is a horizontal sectional view through vertical framing members near a jamb, in accordance with the framing system of FIG.1.

In FIG. 2, a horizontal section 20 is shown through adjacent vertical mullions 30 and 31 in the vicinity of a wall jamb 22. A jamb mullion 31 abuts the wall jamb 22 and an interposed shim 24 with caulking 26 finishing the edge between the jamb mullion and the jamb. The intermediate vertical mullion 30 is a two-piece mullion in that its shallow glazing pocket has a filler assembly 43. The jamb mullion 31 is the same as the intermediate vertical mullion 30 except that a filler assembly is not inserted. Therefore, the jamb mullion 31 is the major piece of a two-piece vertical mullion. The jamb mullion 31 has a deep glazing channel 32 which is thermally broken by a pour-debridge area 34 of a cast resinous plastic material which is heat insulating and relatively rigid.

A dual pane glass panel 36 is situated in the deep glazing pocket 32 and is secured along the periphery of the deep glazing pocket by glazing gaskets 40 and 42. The dual panel glass panel 36 includes along its perimeter a spacer strip 38 separating the dual panes of the panel thereby providing a thermally insulating airspace within the glass panel. Extending between the vertical mullions 30 and 31 is a horizontal intermediate mullion 75, discussed further below, with a horizontal glazing gasket 42 securing the glass panel 36 along its base in the horizontal mullion. The horizontal mullion 75 is secured between the vertical mullions 30 and 31 by screws 76 passing through drilled holes in the vertical mullions into splines 78 inside of the horizontal mullion 75, further discussed below.

Figure 3:
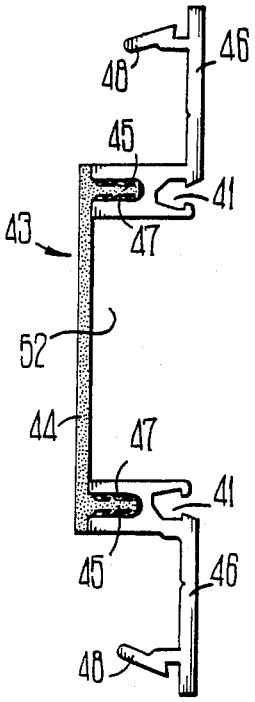
FIG. 3 is a horizontal sectional view of the thermal break filler assembly from the shallow glazing pocket of FIG. 2.

The intermediate vertical mullion 30 in its major portion includes a deep glazing pocket 32 with a pour-debridge thermal break 34, and in its minor portion the shallow glazing pocket filler assembly 43. In FIG. 3, the shallow glazing pocket filler assembly 43 is shown in detail. The base 44 of the elongate filler assembly 43 is extruded from a thermally insulating resinous plastic such as rigid PVC and having a representative thickness of about one sixteenth inch. The filler base 44 is generally channel shaped in cross section and having press fit protrusions 45 along its legs which are press fit into reciprocal pockets in the lateral components 46 of the filler assembly 43. The press fit protrusions 45 are flexible PVC and are coextruded with the filer base 43. The lateral members 46 of the filler assembly include glazing gasket pockets 41 and a snap-engagement clip 48 for securing the filler assembly onto locking flanges 50 in the vertical mullion 30. The lateral members 46 are extruded aluminum similar to the extruded aluminum mullions. The overall lateral dimension of the filler assembly is representatively about 3.5 inches, relative to a mullion depth of about 4:5 inches.

The shallow glazing pocket filler assembly 43 permits a minimum sight line of the vertical mullions 30, representatively about 2 inches, in that the lateral facial dimension of the mullion is reduced by eliminating a pour-debridge thermal break in the shallow glazing pocket.

Figure 4:
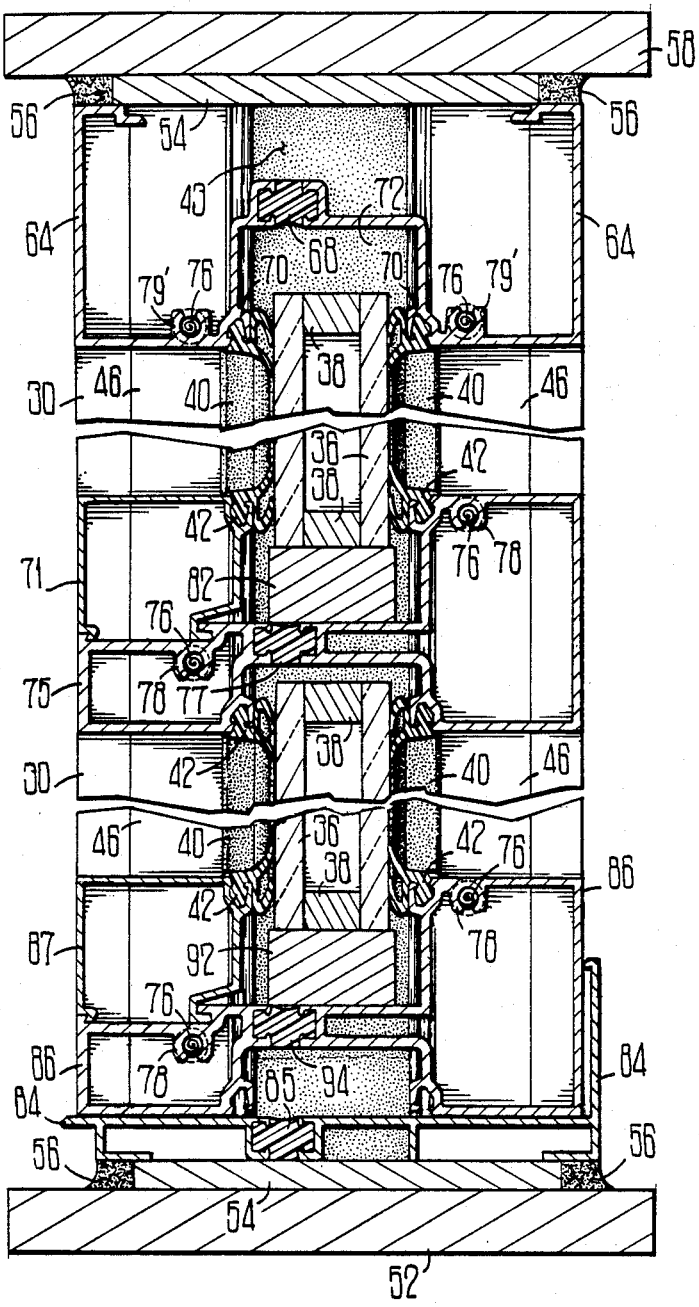
FIG. 4 is a vertical sectional view through horizontal framing members, in accordance with the framing system of FIG. 1.

In FIG. 4, a vertical section is shown through a typical series of horizontal mullions including a header mullion 64, an intermediate horizontal mullion 75, and a footer mullion 86 along the floor 52 of the structural wall opening in which the framing is installed. The header mullion 64 extends along the ceiling 58 with a shim 54 and a caulking 56 interposed. The header mullion 64 is secured to the vertical mullion 30 with screws 76 threaded into splines 79' in the same manner discussed above in connection with horizontal mullion 75 in FIG. 2. The splines 79' are integrally formed with the extruded aluminum mullion. Note that the header mullion 64 is the same extruded profile as the major piece of a vertical mullion, such as the vertical jamb mullion 31. The header mullion 64 includes a deep glazing pocket 72 with a pour-debridege thermal break 68. A dual pane glass panel 36 is situated in the glazing channel 72 by means of glazing gaskets 40 and 42 extending along the perimeter of the glass panel 36.

At an intermediate level in the framing structure, an intermediate horizontal mullion 75 is indicated which is a two-piece mullion having as its minor part a face insert 71. The glass panel 36 rests on a setter block 82 along the horizontal intermediate mullion 75 and is secured by the face member 71 which is snap fit onto the exterior upper side of intermediate mullion 75 and which urges the glazing gaskets 42 against the glass panel 36. The intermediate horizontal mullion 75 is secured to the vertical mullion 30 with screws 76 passing through the vertical mullion and turned into splines 78 which are integral with the horizontal mullion.

At the bottom of the framing assembly, the footer horizontal mullion 86 is seated in a still member 84 which rests on the floor 52 with a shim 54 interposed and having finishing lines 56 of caulking. The sill member 84 has a pour-debridge thermal break 85. The footer mullion 86 is substantially similar to a horizontal intermediate mullion and is secured to the vertical mullion 30 with screws 76 passing through the vertical mullion and turned into splines 78 which are integral with the horizontal sill mullion. The footer mullion 86 includes a pour-debridge thermal break 94. A glass panel 36 rests on a setter block 92 along the footer mullion 86 and is secured in place by a face member 87 being snap fit onto the footer mullion 86 which in turn urges the glazing gaskets 42 against the glass panel 36.

While the invention has been described in detail with particular reference to the disclosed embodiments, it is to be understood that variations and modifications may be utilized without departing from the principles and scope of the invention as defined by the following claims.

What is claimed is:

1. A thermal mullion for narrow flush glazed framing, comprising:

an extruded structural profile having on one side a deep glazing channel and on the opposed side a slot for forming a shallow glazing channel;

a thermal break in the deep glazing channel; and a thermal break filler assembly comprising a base formed at least in part of a relatively low thermal conductivity material and a pair of elongated lateral members, said base engaging each of said pair of lateral members to secure said pair of lateral members in parallel, spaced-apart relation, said pair of lateral members engaging said structural profile to secure said thermal break filler assembly within said slot, said thermal break filler assembly being configured to form a shallow glazing channel in said structural profile.

2. The mullion of claim 1, wherein said structural profile comprises a wall defining a base of said deep glazing channel, and wherein said thermal break in the deep glazing channel comprises a pour-debridge thermal break in the base of the deep glazing channel.

3. The mullion of claim 1, wherein each of said pair of lateral members defines a channel therein, and wherein said thermal break filler assembly further comprises a plastic channel extrusion having rigid upturned legs with relatively soft coextruded barbs which engage said channels in said pair of lateral members, such that the base of said thermal break filler assembly is snap fit onto and between said pair of lateral members to form said thermal break filler assembly.

4. The mullion of claim 1, wherein said structual profile further comprises locking flanges formed on either side of said slot, and wherein siad lateral members comprise snap-engagement clips formed thereon for engaging said locking flanges on said structural profile to secure said thermal break filler assembly to said structural profile.

5. A narrow flush-glazed thermal framing system comprising:

a pair of vertical jamb mullions disposed in spaced-apart relation and defining the outer lateral boundaries of said framing system; and a vertical intermediate mullion comprising:

an extruded structural profile having on one side a deep glazing channel and on the opposed side a slot for forming a shallow glazing channel;

a thermal break in the deep glazing channel; and a thermal break filler assembly comprising a base formed at least in part of a relatively low thermal conductivity material and a pair of elongated lateral members, said base engaging each of said pair of lateral members to secure said pair of lateral members in parallel, spaced-apart relation, said pair of lateral members engaging said structural profile to secure said thermal break filler assembly within said slot, said thermal break filler assembly being configured to form a shallow glazing channel in said structural profile.

6. The framing system of claim 5, wherein said vertical intermediate mullion and said pair of vertical jamb mullions have upper and lower ends, and further comprising:

a horizontal header mullion joining said vertical intermediate mullion and said pair of vertical jamb mullions at their upper ends and defining the upper boundaries of said framing system;

a horizontal footer mullion joining said vertical intermediate mullion and said pair of vertical jamb mullions at their lower ends and defining the lower boundaries of said framing system;

said header and footer mullions each including splines formed thereon; and said header and footer mullions being joined to said vertical intermediate mullion and said vertical jamb mullions by screws inserted through said vertical mullions and engaging said splines on said horizontal mullions.

* * * * *